US010408572B2

(12) United States Patent
Matthews

(10) Patent No.: US 10,408,572 B2
(45) Date of Patent: Sep. 10, 2019

(54) ILLUMINATED BOW SIGHT

(71) Applicant: Murray Matthews, Lewistown, MT (US)

(72) Inventor: Murray Matthews, Lewistown, MT (US)

( * ) Notice: Subject to any disclaimer, the term of this patent is extended or adjusted under 35 U.S.C. 154(b) by 72 days.

(21) Appl. No.: 15/677,263

(22) Filed: Aug. 15, 2017

(65) Prior Publication Data

US 2019/0056197 A1 Feb. 21, 2019

(51) Int. Cl.

| | |
|---|---|
| ***F41G 1/467*** | (2006.01) |
| ***F41G 1/34*** | (2006.01) |
| ***F41G 1/44*** | (2006.01) |

(52) U.S. Cl.

CPC ..... *F41G 1/467* (2013.01); *F41G 1/345* (2013.01); *F41G 1/44* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,567,668 | A * | 2/1986 | King | F41G 1/467 33/265 |
| 5,339,227 | A * | 8/1994 | Jones | F21V 33/008 124/87 |
| 5,630,279 | A * | 5/1997 | Slates | F41G 1/467 124/87 |
| 10,151,561 | B1 * | 12/2018 | Bartak | F41G 1/44 |
| 2007/0089307 | A1 * | 4/2007 | Labowski | F41G 1/467 33/265 |
| 2009/0000134 | A1 * | 1/2009 | Kurtzhals | F41G 1/467 33/265 |
| 2017/0010069 | A1 * | 1/2017 | Mason | F41G 1/467 |
| 2017/0138698 | A1 * | 5/2017 | York | F41G 1/38 |
| 2018/0180381 | A1 * | 6/2018 | Grace, Jr. | F41C 23/10 |
| 2019/0120595 | A1 * | 4/2019 | McRee | F41G 1/44 |

* cited by examiner

*Primary Examiner* — Charlie Y Peng

(57) ABSTRACT

An illuminated bow sight comprises a level and an illumination source disposed on an archery bow. This level is disposed between a user and a source of light in a manner to allow light to strike the user's eye when the roll of the bow along a front-to-back axis is substantially at the rate desired by the user, i.e., has substantially no roll with respect to its desired orientation. More specifically, the invention relates to a level having a bubble being disposed between a light source and the user's eye. The medium of the level is substantially more opaque than the medium of the bubble, allowing substantially more light to pass through the level and to strike the user's eye when the bow has substantially no roll with respect to its desired orientation.

5 Claims, 3 Drawing Sheets

ILLUMINATED BOW SIGHT

BACKGROUND OF THE INVENTION

Field of the Invention

The present invention relates to an illuminated sight on an archery bow for notifying a user when the archery bow has substantially zero roll along a front-to-back axis with respect to its desired orientation.

Description of the Prior Art

Prior to this instant invention, many bow sights have used levels to indicate the orientation of a bow. And, many of these bow sights have included a source of light to aid the user in viewing the status of the level. However, all such illuminated bow sight levels suffer from the same drawback. Specifically, the prior art has required the user to focus his attention on the level to ascertain its status. No matter how brief this focus need be, it requires the user to direct focus away from either the target or other elements of the bow sight. And, once the user has focused on the level, he then must redirect his focus to ensure that the bow sight is still on target. No matter how brief this redirection of focus is, it creates an opportunity for the level to deviate from its desired orientation. A bow sight that allows a user to maintain focus on the target and to be simultaneously notified of the orientation of the level is desired.

SUMMARY OF THE INVENTION

The present invention overcomes the disadvantages and limitations of the prior arts by providing a level disposed on an archery bow. This level is disposed between a user and a source of light in a manner to allow light to strike the user's eye when the roll of the bow along a front-to-back axis is substantially at the rate desired by the user, i.e., has substantially zero roll with respect to its desired orientation. More specifically, the invention relates to a level having a bubble being disposed between a light source and the user's eye. The medium of the level is substantially more opaque than the medium of the bubble, allowing substantially more light to pass through the level and to strike the user's eye when the bow has substantially zero roll with respect to its desired orientation.

Various other purposes and advantages of the invention will become clear from its description in the specification that follows and from the novel features particularly pointed out in the appended claims. Therefore, this invention comprises the features hereinafter illustrated in the drawings, fully described in the detailed description of the preferred embodiments, and particularly pointed out in the claims. However, such drawings and description, as well as this Summary of the Invention, disclose just a few of the various ways in which the invention may be practiced and are not limiting on the invention.

DESCRIPTION OF THE INVENTION

The present invention overcomes the disadvantages and limitations of the prior arts by providing a level disposed on an archery bow between a user and a source of light in a manner to allow light to strike the user's eye when the roll of the bow along a front-to-back axis is substantially at the rate desired by the user, i.e., has substantially no roll with respect to its desired orientation. More specifically, the invention relates to a level having a bubble being disposed between a light source and the user's eye. The medium of the level is substantially more opaque than the medium of the bubble, allowing substantially more light to pass through the level and to strike the user's eye when the bow has substantially no roll with respect to its desired orientation.

Figure 1:
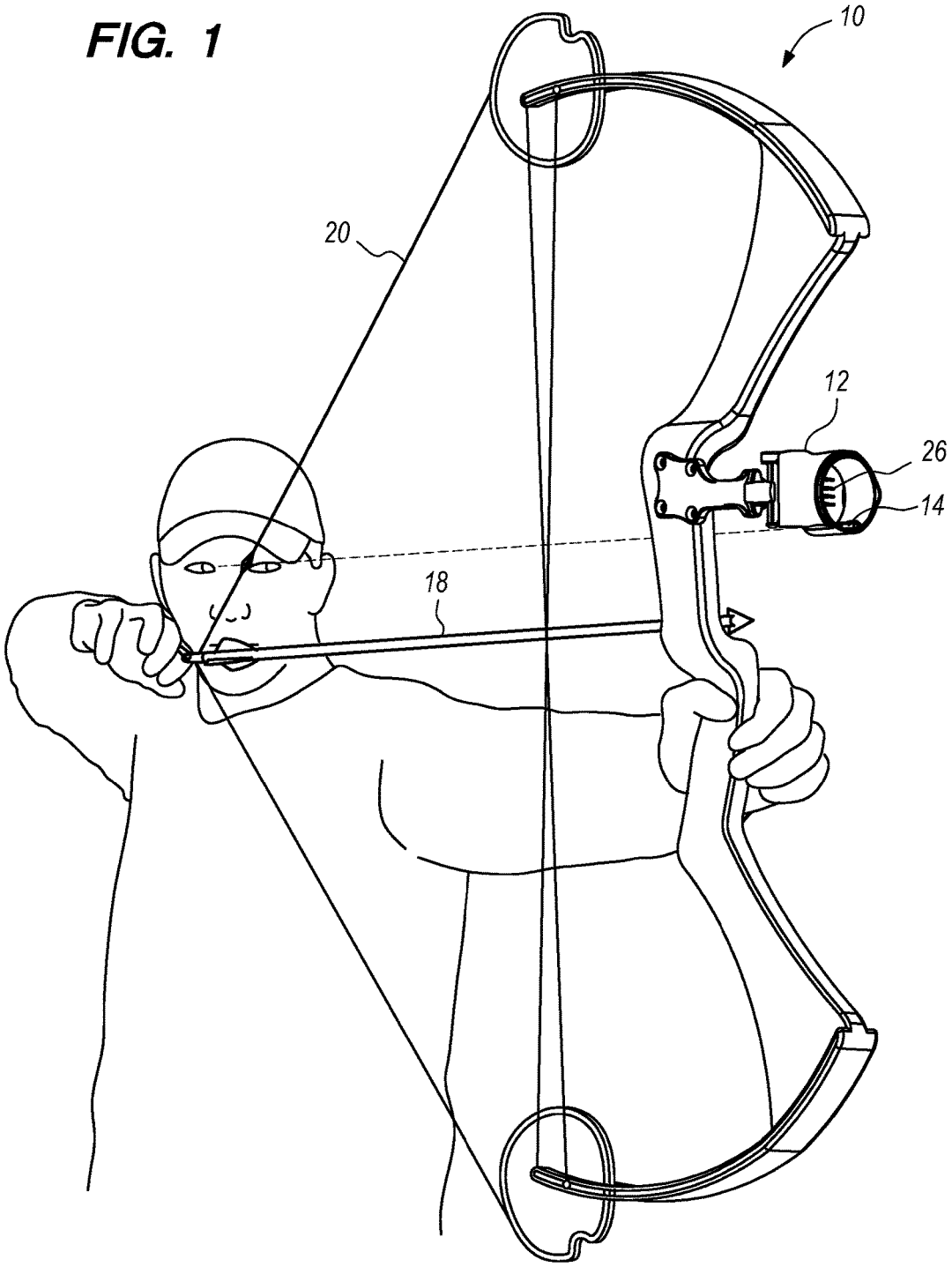
FIG. 1 is a three dimensional illustration of an archery bow comprising an illuminated bow sight, according to the invention.

Referring to the figures, wherein like parts are designated with like reference numerals and symbols, FIG. 1 is a three dimensional illustration of an archery bow 10 having an illuminated bow sight comprising an illumination source 14. The archery bow 10 includes three (3) planes of rotation, as defined from the aspect of an arrow 18 notched into a draw string 20. For purposes of this discussion, the position of the arrow 18 is considered while the draw string 20 has been pulled by the user into a firing position. The three planes of rotation are yaw, pitch, and roll. Yaw is defined as rotation around the vertical axis. In this embodiment of the invention, the vertical axis is perpendicular to the ground and passes through the center of the arrow 18. Pitch is defined as rotation around the side-to-side axis. In this embodiment of the invention, the side-to-side axis is substantially parallel to the ground and passes through the tip of the arrow 18. Roll is defined as rotation around the front-to-back axis. In this embodiment of the invention, the front to back axis passes through the long axis of the arrow 18. This invention specifically addresses roll of the archery bow 10 around the front-to-back axis which passes through the long axis of the arrow 18.

An illumination source 14 is placed within an illuminated bow sight 12 at the front of the archery bow 10 and oriented so that light leaving the illumination source will point back to the user's eye. This illumination source 14 could be, but is not limited to, a light bulb, a light-emitting diode, or a fiber-optic cable. Illumination sources for bow sights are well known in the art and are not the subject of this instant invention. In the embodiment illustrated in FIG. 1, the archery bow 10 is oriented to allow the drawstring 20 to be substantially vertical with respect to the earth. The desired pitch of the bow 10 is commonly ascertained by sight pins 26. The desired yaw of the archery bow 10 is obtained by the user 18 either aiming the archery bow 10 at a target or slightly in front of a moving target. Other embodiments of the instant invention might orient the drawstring 20 substantially horizontal to the earth, such as a cross bow, or some at some other desired angle, such as a forty-five (45) degree angle formed by the drawstring 20 and the ground.

Figure 2:
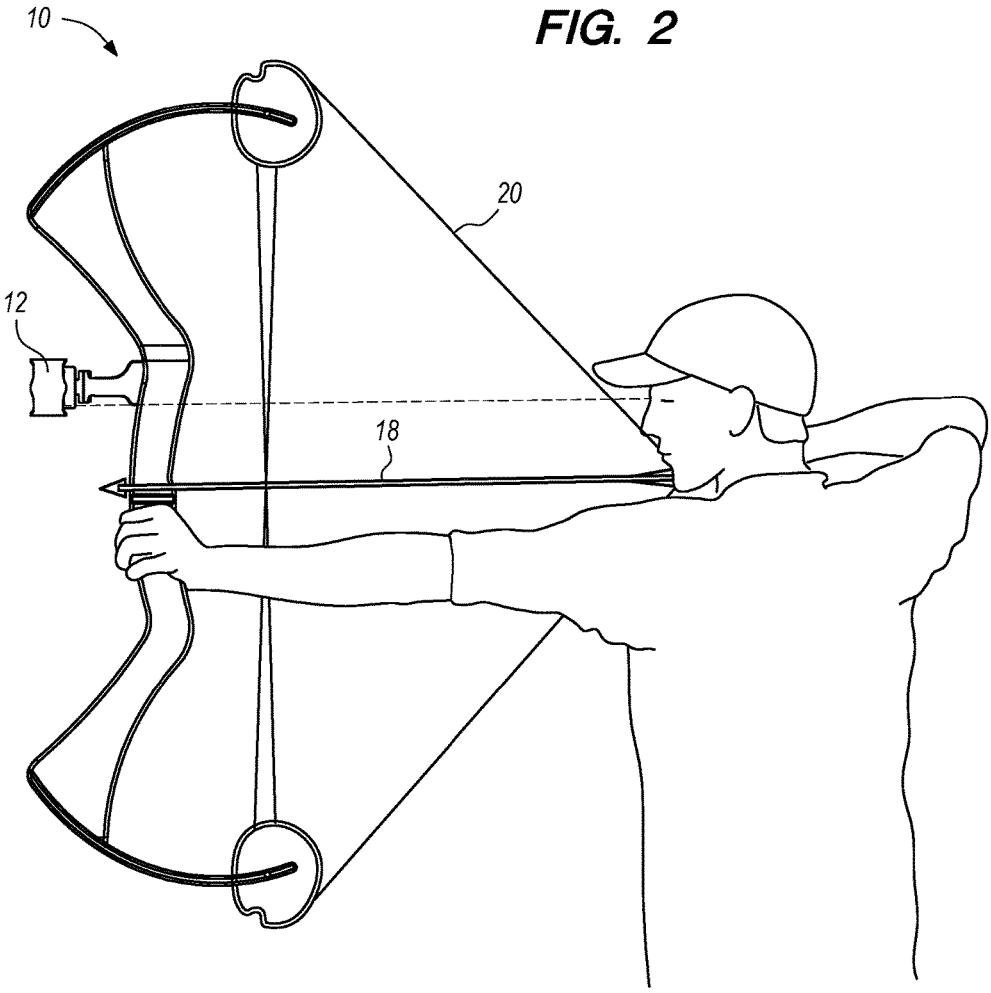
FIG. 2 is a two dimensional illustration of a side view of the archery bow illustrated FIG. 1.

FIG. 2 is a two dimensional illustration of a side view of the archery bow 10 of FIG. 1. The drawstring 20 is shown in a drawn position and an arrow 18 has been notched into the drawstring.

Figure 3:
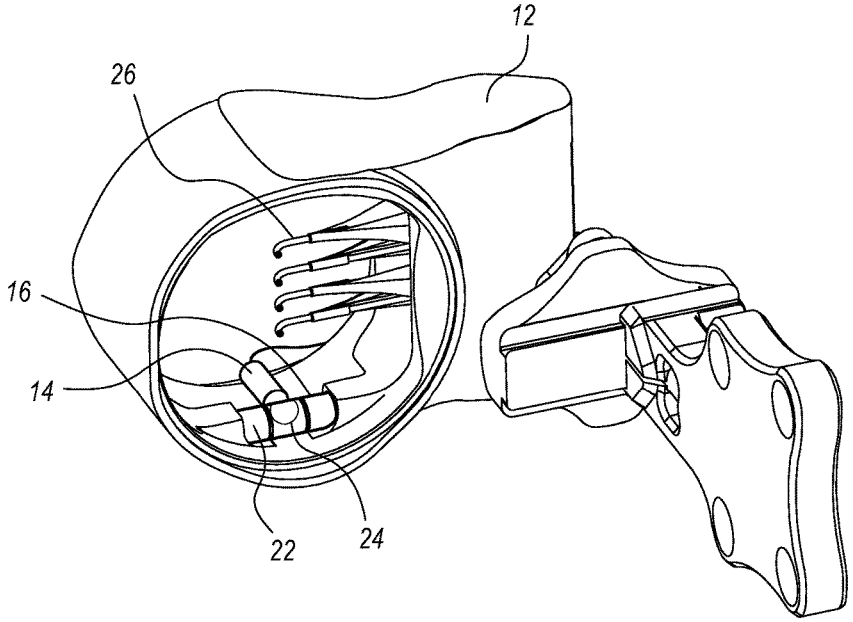
FIG. 3 is a three dimensional illustration of the illuminated bow sight of FIG. 1, according to the invention.

FIG. 3 is a three dimensional illustration of the illuminated bow sight 12 of FIG. 1, according to the invention, including the sight pins 26, the illumination source 14, and a level 16. The combination of the illumination source 14 and the level 16 and the relative placement of each in relation to a user form the basis for the instant invention. The level 16 includes a substantially opaque medium 22 and a substantially transparent medium 24 commonly referred to as a bubble. The substantially opaque medium 22 and the substantially transparent medium 24 reside within the level 16. In this embodiment of the invention, the substantially opaque medium 22 is comprised of a liquid and the substantially transparent medium 24 is a gas such as nitrogen, oxygen, or air. Alternatively, the substantially transparent medium 24 could be vacuum, a solid such as glass or plastic, or a liquid which is dissimilar to the substantially opaque medium 22, so long as the density of the substantially transparent medium 24 is substantially different from that of the substantially opaque medium 22. Levels of this type are well known in the art and are not the subject of this instant invention. Rather, the innovative aspect of this instant invention is the placement of the level with respect to the illumination source 14 and the user.

Once the user ascertains a desired orientation of roll of the archery bow 10, the level 16 is placed so that the level 16 is substantially horizontal with respect to the ground. Further, the level 16 is placed between the illumination source 14 and the user so that light will pass directly from the illumination source 14 through the substantially transparent medium 24 and directly into the user's eye when the bow's roll is substantially in its desired orientation. In this embodiment of the invention, light travels a substantially straight path from the illumination source 14 to the user's eye, subject to minute and almost imperceptible deviation due to heat, gravity, and atmospheric perturbation. This direct path is illustrated in both FIGS. 1 and 2. This allows the user to ascertain the status of the roll of the archery bow 10 along the front-to-back axis using peripheral vision. This eliminates the need for the user to focus directly on the level and allows the user to maintain focus on the user's intended target.

Figure 4:
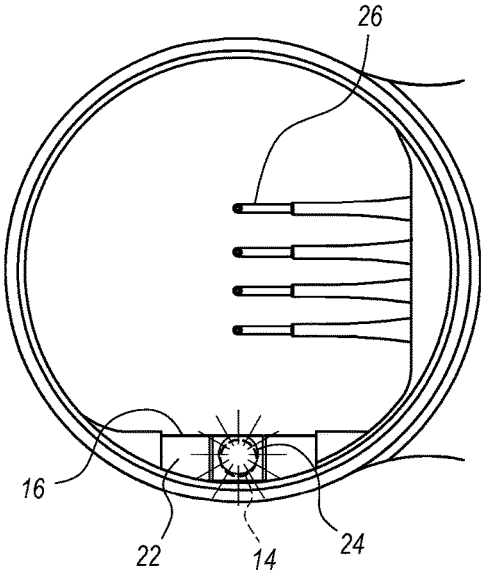
FIG. 4 is a two dimensional illustration of the illuminated bow sight of FIG. 1, according to the invention, as viewed from the perspective of a user's eye while the archery bow of FIG. 1 is substantially aligned with the desired roll of the archery bow along a front-to-back axis.

FIG. 4 is a two dimensional illustration of the illuminated bow sight 12 of FIG. 1, according to the invention, as viewed from the perspective of a user's eye while the archery bow of FIG. 1 is substantially aligned with the desired roll of the archery bow 10 along a front-to-back axis. While the roll of the archery bow 10 along the front-to-back axis is substantially at or near the desired orientation, the level 16 substantially parallel to the earth and the substantially transparent medium 24 (bubble) becomes positioned in front of the illumination source 14. This allows light emitting from the illumination source 14 to strike the user's eye with requiring the user to focus on the level 16.

Figure 5:
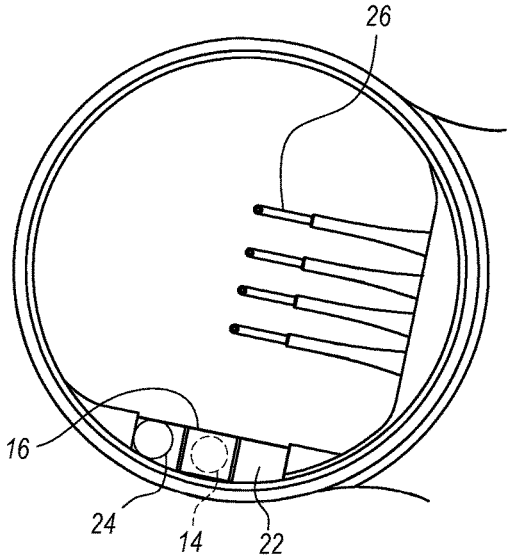
FIG. 5 is a three dimension illustration of the illuminated bow sight of FIG. 1, according to the invention, as viewed from the perspective of a user's eye while the archery bow of FIG. 1 is not substantially aligned with the desired roll of the archery bow along a front-to-back axis.

FIG. 5 is a three dimension illustration of the illuminated bow sight 12 of FIG. 1, according to the invention, as viewed from the perspective of a user's eye while the archery bow 10 of FIG. 1 is not substantially aligned with the desired roll of the archery bow along a front-to-back axis. Here, the roll of the archery bow 10 along the front-to-back axis is not substantially at or near the desired orientation. The substantially opaque medium 22 is interposed between the illumination source 14 and the user's eye. Once again, this allows the user to ascertain the status of the archery bow 10 along the front-to-back axis without focusing on the level 16. In this case, there is substantially less light from the illumination source 14 striking the user's eye.

I claim:

1. An illuminated bow sight for ascertaining roll of an archery bow along a front-to-back axis of said archery bow, said illuminated bow sight comprising:

an illumination source attached to the archery bow, said illumination source being positioned to shine light directly into the eye of a user of the archery bow; and a level attached to the archery bow between the illumination source and the user of the archery bow, said level comprising a substantially opaque medium and a substantially transparent medium, wherein said level allows light to travel a substantially straight path from the illumination source to the user's eye only when the substantially transparent medium indicates that the level is substantially parallel to the earth.

2. The illuminated bow sight of claim 1 wherein the archery bow comprises an arrow notched into a drawstring, said arrow having a long axis, and the front-to-back axis of the archery bow passes through the long axis of the arrow.

3. The illuminated bow sight of claim 1 wherein the archery bow comprises a drawstring and the level is positioned in a manner to be substantially parallel to the earth when the drawstring is substantially perpendicular to the earth.

4. The illuminated bow sight of claim 1 wherein the archery bow comprises a drawstring and the level is positioned in a manner to be substantially parallel to the earth when the drawstring is substantially parallel to the earth.

5. The illuminated bow sight of claim 1 wherein the archery bow comprises a drawstring and the level is positioned in a manner to be substantially parallel to the earth when the drawstring and the earth substantially form a forty-five degree angle.

* * * * *